United States Patent [19]

Wells et al.

[11] 4,440,597

[45] Apr. 3, 1984

[54] WET-MICROCONTRACTED PAPER AND CONCOMITANT PROCESS

[75] Inventors: Edward R. Wells, Cincinnati; Thomas A. Hensler, West Chester, both of Ohio

[73] Assignee: The Procter & Gamble Company, Cincinnati, Ohio

[21] Appl. No.: 358,500

[22] Filed: Mar. 15, 1982

[51] Int. Cl.[3] ..... D21H 5/24

[52] U.S. Cl. ..... 162/111; 162/112; 162/113; 162/118; 162/123; 162/188; 428/154

[58] Field of Search ..... 162/111, 113, 123, 117, 162/109, 197, 204, 112, 118, 188; 428/153, 154

[56] References Cited

U.S. PATENT DOCUMENTS

| | | | |
|---|---|---|---|
| 3,301,746 | 1/1967 | Sanford et al. | 162/113 |
| 3,994,771 | 11/1976 | Morgan et al. | 162/113 |
| 4,072,557 | 2/1978 | Schiel | 162/111 |
| 4,102,737 | 7/1978 | Morton | 162/113 |
| 4,191,609 | 3/1980 | Trokhan | 162/113 |
| 4,239,065 | 12/1980 | Trokhan | 139/383 A |

FOREIGN PATENT DOCUMENTS

| | | | |
|---|---|---|---|
| 879436 | 8/1971 | Canada . | |
| 1212473 | 11/1970 | United Kingdom | 162/109 |

OTHER PUBLICATIONS

Gunnar Stenberg, A New Papriformer from KMW, Jan. 15, 1972, vol. 75, No. 1, pp. 26–28, Translated from: Sv. Papperstidn.

*Primary Examiner*—Peter Chin

*Attorney, Agent, or Firm*—Thomas J. Slone; Fredrick H. Braun; Richard C. Witte

[57] ABSTRACT

High bulk, absorbent paper having a relatively high MD elongation at rupture, and a substantially greater stress/strain modulus in the lowest one-third of its range of MD extensibility—preferably when wet—than equally machine-direction-stretchable, purely dry-foreshortened (e.g., dry-creped) paper having substantially identical MD elongation at rupture. The process includes a differential velocity transfer of a wet-laid embryonic web having relatively low fiber consistency from a carrier to a substantially slower moving, open-mesh transfer fabric having a substantial void volume; and thereafter drying the web while precluding substantial macroscopic rearrangement of the fibers in the plane of the web. The differential velocity transfer is effected without substantial compaction of the web by avoiding substantial mechanical pressing, centrifugal slinging, air blasting, and the like. The MD stress-strain property of the paper when wet is directly related to the magnitude of the differential velocity at transfer; to the magnitude of the wet-strength property of the paper; and to the topography of the transfer fabric.

27 Claims, 18 Drawing Figures

WET-MICROCONTRACTED PAPER AND CONCOMITANT PROCESS

DESCRIPTION

1. Technical Field

This invention pertains to tissue paper having high bulk, high liquid absorbency, and high machine direction extensibility; and to methods of making such paper. More specifically this invention pertains to such tissue paper which, relative to dry-creped tissue paper, has a substantially higher machine direction stress/strain modulus through its low range of machine direction extensibility; and a process for making such tissue paper which process includes substantially foreshortening a wet-laid paper web in the wet end of a papermaking machine under such conditions that the foreshortening does not precipitate substantial compaction or densification of the web.

2. Background Art

Tissue paper having high bulk (i.e., low density), high liquid absorbency, and high machine direction (MD) extensibility is disclosed in U.S. Pat. No. 3,301,746 which issued Jan. 31, 1967 to L. H. Sanford and J. B. Sisson. Briefly, their invention involves predrying an uncompacted paper web, and then imprinting a knuckle pattern from an imprinting fabric into the paper web under high pressure. Thus, portions of the web are compacted by the high pressure and the remainder of the web remains uncompacted. The compacted portions contribute strength; and the uncompacted portions preserve bulk. The MD extensibility is, predominantly, precipitated by dry creping. Such dry-creped paper manifests a very low MD stress/strain modulus until a high percentage of its MD extensibility is pulled out. Thus, when it is desirable to retain a substantial portion of dry creping induced MD extensibility, control of the web downstream of the creping blade is very difficult because substantial tensioning of the web to facilitate its control is virtually precluded: especially with respect to low strength tissue paper at high machine speeds (e.g., greater than three-thousand-feet-per-minute) (about 914 m/min). U.S. Pat. No. 3,994,771 which issued Nov. 30, 1976 to George Morgan, Jr. and Thomas F. Rich extended this technology to layered paper, the title of the patent being Process For Forming A Layered Paper Web Having Improved Bulk, Tactile Impression And Absorbency And Paper Thereof.

A Method And Apparatus For Shrinking A Traveling Web Of Fiberous Material in the wet end of a papermaking machine is disclosed in U.S. Pat. No. 4,072,557 which issued Feb. 7, 1978 to Christian Schiel. The Schiel invention is apparently presented as an alternative to dry-creping and the like for webs having insufficient strength to undergo dry creping and the like; and/or a way of achieving a shrunken web from a given furnish in such a way that the web has a higher MD tensile strength than were equal shrinkage precipitated by dry-creping or the like. Basically, the Schiel invention involves transferring a wet paper web from a porous carrier fabric to a slower moving transfer fabric by passing them in juxtaposed relation across a centrifugal force inducing transfer head, and applying a differential pressure across them and the transfer head. Inferentially, it is believed that paper produced by practicing the Schiel invention would not have high bulk, and its MD stress/strain property is not elucidated. That is, the Schiel patent focuses on achieving a shrunken web of high ultimate strength rather than achieving a high bulk tissue having high MD extensibility and a relatively high stress/strain modulus through its low and intermediate ranges of extensibility than dry-creped paper as is provided by the present invention.

A Method For Manufacturing On A Paper Machine Paper Which Has Good Friction Characteristics And/Or Which Is Stretchable is disclosed in Canadian Pat. No. 879,436 which issued Aug. 31, 1971, and British Pat. No. 1,212,473 which published Nov. 18, 1970 which patents were both apparently derived from a common Finnish patent application having a priority date of Mar. 1, 1968. These patents also disclose a papermaking process which includes a wet-end differential velocity transfer which, as a rule, is effected at less than a seven percent velocity differential. Successive differential velocity transfers are discussed as a means of making it possible to shorten the paper web to a high degree: presumably substantially greater than seven percent. Achieving stretchable paper having a high coefficient of friction is a primary objective of the invention whereas achieving high bulk is apparently not inasmuch as all of the figures disclose wet press sections downstream from the differential velocity transfer zone.

As compared to the background art described above, the present invention provides MD-stretchable tissue paper having high bulk and, relative to equally MD foreshortened dry-creped tissue paper made from the same furnish, a substantially higher stress/strain modulus in the low range of its MD extensibility albeit a somewhat reduced MD tensile rupture strength. Such paper is produced by a method which includes a differential velocity transfer of a web in the wet end of a papermaking machine that avoids substantial compaction of the web. Through such a substantially non-compacting transfer onto a transfer fabric having a substantial void volume, the web is said to be wet-microcontracted: that means, substantially foreshortened—preferably from about ten percent to about forty percent—in the machine direction without substantially increasing the web density. The process also includes drying the paper after the wet-end foreshortening without overall compaction and without substantially altering the fiber arrangement in the plane of the web. However, the process may include after the post-wet-microcontracting step, pattern imprinting in accordance with U.S. Pat. No. 3,301,746 to improve its tensile strength; and some degree of dry-creping to achieve a product having a hybrid stress/strain modulus: i.e., a stress/strain modulus between those of a purely wet-microcontracted web and a purely dry-creped web having the same overall MD foreshortening, and made from the same furnish in essentially the same way albeit the different manners of precipitating the MD foreshortening. Such paper is substantially easier to control (e.g., reel) in the dry end of a papermaking machine, and is especially useful in multi-ply tissue paper products wherein the plies have substantially different stress/strain properties: particularly wherein the stress/strain properties are sufficiently different to have different characters but which have sufficiently matched elongations at rupture that the multi-ply products have monomodal stress/strain characters. By way of defining stress/strain properties of different characters, a stress/strain property which, if plotted on a graph, is upwardly concave (i.e., concave as viewed from above) is hereby defined to have a different character than a substantially linear plot or a reversely curved plot: i.e., a stress/strain property which when graphed produces an upwardly convex plot.

DISCLOSURE OF THE INVENTION

In accordance with one aspect of the invention, a process is provided for making high bulk, MD-extensible tissue paper having an MD stress/strain property substantially different from comparably extensible dry-creped paper; that is, different by virtue of having a substantially greater MD stress/strain modulus through its low and moderate ranges of MD extensibility. This is achieved by forming an embryonic web from an aqueous fibrous papermaking furnish, and non-compressively removing sufficient water therefrom prior to its reaching a transfer zone on a carrier fabric that it has a predetermined fiber consistency at the transfer zone. The consistency prior to the transfer is preferably from about ten to about thirty percent fibers by weight and, more preferably, from about ten to about twenty percent fibers by weight and, most preferably, from about ten to about fifteen percent fibers by weight. Dry and/or wet strength additives may be included in the furnish or applied to the web after its formation to impart a predetermined level of strength to the web. At the transfer zone, the back side of a transfer (i.e., receiving) fabric traverses a convexly curved transfer head. While the transfer fabric is so traversing the transfer head, the carrier fabric is caused to converge and then diverge therewith at sufficiently small acute angles that compaction of the web therebetween is substantially obviated. The transfer fabric has a substantial void volume, and is forwarded at a predetermined lesser velocity than the carrier fabric; preferably the lesser velocity is from about ten to about forty percent slower and, more preferably, from about fifteen percent to about thirty percent slower than the velocity of the carrier fabric. Preferably, the transfer fabric has a sufficient void volume by virtue of being an open weave and having a mesh count of from about four to about thirty filaments per centimeter in both the machine direction and the cross-machine direction and, more preferably, from about six to about twenty-six filaments per centimeter in both directions and, most preferably, from about six to about fifteen filaments per centimeter in both directions. At the transfer zone, only a sufficient differential gaseous pressure—preferably vacuum applied through the transfer head—is applied to the web to cause it to transfer to the transfer fabric without substantial compaction: i.e., without a substantial increase in its density. The web is thereafter dried without overall compaction thereof and without substantially altering the macroscopic fiber arrangement in the plane of the web. Preferably, however, the web is imprinted with the knuckle pattern of the transfer fabric under high pressure to precipitate tensile strength bonds, and the web preferably is sufficiently dry-creped to substantially reduce any harshness which might otherwise be precipitated by such imprinting. The web may then be lightly calendered for caliper control and reeled or directly converted to paper products. The calender or the reel may be operated at such a speed relative to the dry-creping velocity of the web that the finished paper has a predetermined residual degree of dry crepe or virtually none at the papermaker's option or as desired from the paper properties viewpoint.

BRIEF DESCRIPTION OF THE DRAWINGS

While the specification concludes with claims particularly pointing out and distinctly claiming the subject matter regarded as forming the present invention, it is believed the invention will be better understood from the following description taken in conjunction with the accompanying drawings in which identical designators in the several views refer to substantially identical entities such as papermaking machine components, and in which:

DETAILED DESCRIPTION OF THE INVENTION

Figure 1:
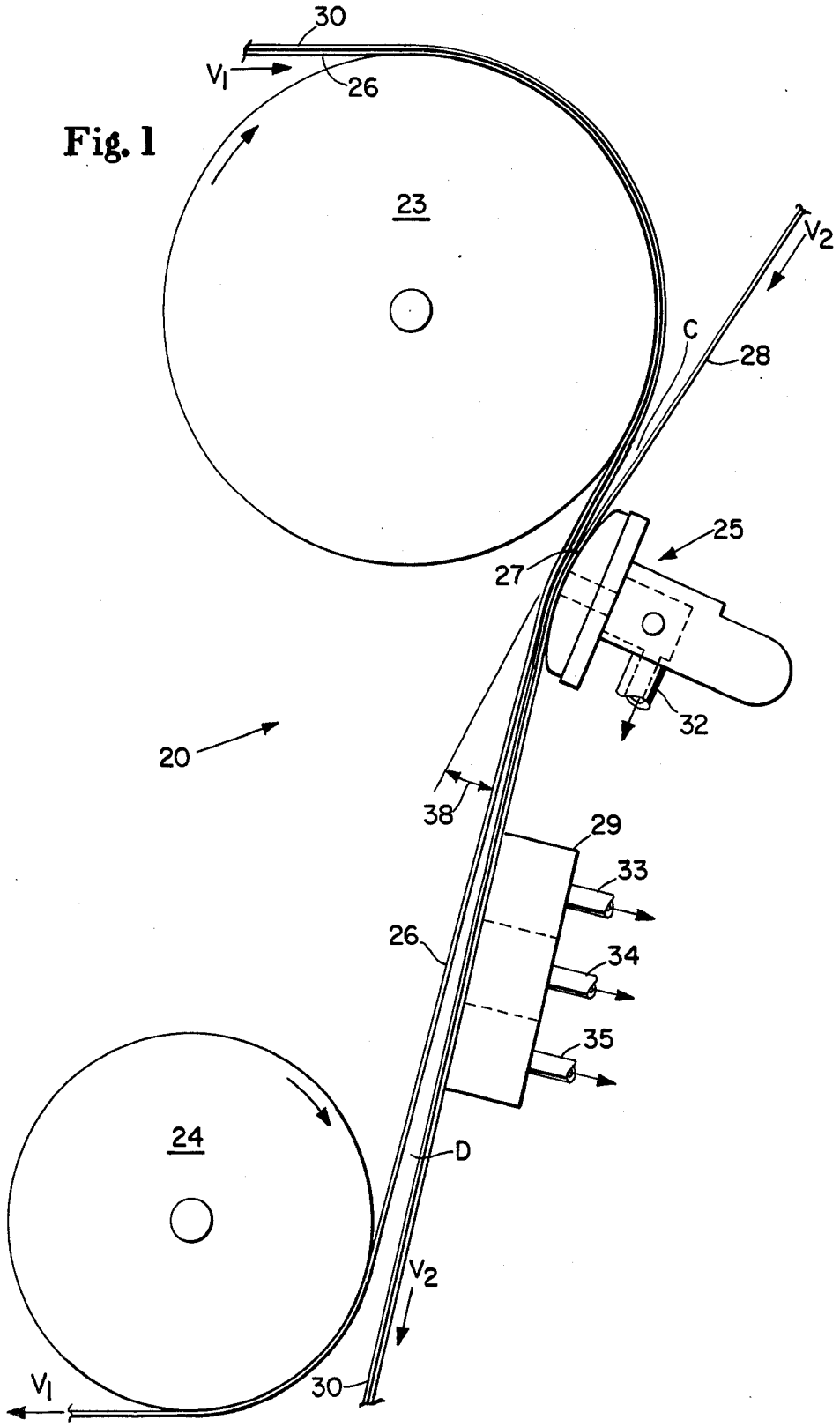
FIG. 1 is a fragmentary, side elevational view of a transfer zone of an exemplary papermaking machine through the use of which the method of the present invention may be practiced.
Figure 2:
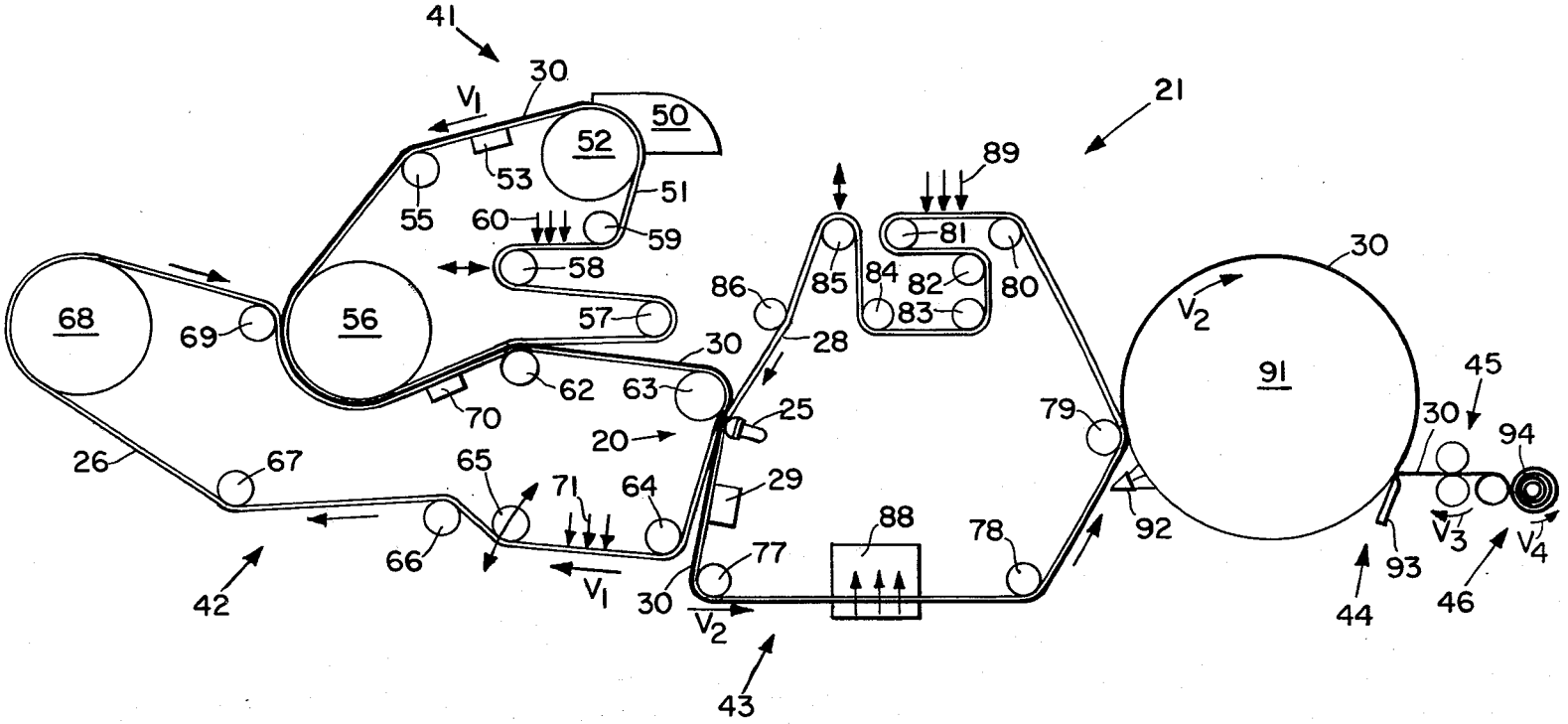
FIG. 2 is a somewhat schematic side elevational view of a papermaking machine in which a transfer zone such as shown in FIG. 1 is incorporated and through the use of which the present invention may be practiced.

FIG. 1 shows a differential-velocity transfer zone 20 of an exemplary papermaking machine 21, FIG. 2, with which the method of the present invention may be practiced, and through the use of which papermaking machine paper embodiments of the present invention may be produced.

Briefly, the method of the present invention involves the formation of a paper web from an aqueous slurry of papermaking fibers; forwarding the web at a low fiber consistency on a foraminous member to a differential velocity transfer zone where the web is transferred to a slower moving member such as a loop of open weave fabric to achieve wet-microcontraction of the web in the machine direction without precipitating substantial macrofolding (defined hereinafter) or compaction of the web; and, subsequent to the differential velocity transfer, drying the web without overall compaction and without further material rearrangement of the fibers of the web in the plane thereof. The paper may be pattern compacted by imprinting a fabric knuckle pattern into it prior to final drying; and the paper may be creped after being dried. Also, primarily for product caliper control, the paper may be lightly calendered after being dried. A primary facet of the invention is to achieve the differential velocity transfer without precipitating substantial compaction (i.e., densification) of the web. Thus, the web is said to be wet-microcontracted as opposed to being wet-compacted or macrofolded or the like.

The principal process parameters which determine the ultimate density, and stress/strain modulus and character of paper embodiments of the present invention include: the percentage velocity difference between the carrier fabric and the transfer fabric; the fiber consistency of the web when undergoing the differential velocity transfer; the void volume and topography of the transfer fabric; the geometry of the transfer zone; strength additives; creping angle if creped; and degree of residual crepe if dry-creped.

Referring again to FIG. 1, transfer zone 20 is seen to comprise couch roll 23, return roll 24, transfer head 25, carrier fabric 26 looped about rolls 23 and 24 and across the convex facing surface 27 of transfer head 25, transfer fabric 28 which is lead across transfer head 25 intermediate surface 27 and the carrier fabric 26 and thence across vacuum box 29. As shown in FIG. 1, web 30 is forwarded at velocity $V_1$ to transfer zone 20 on carrier fabric 26 and is forwarded at velocity $V_2$ from the transfer zone 20 on transfer fabric 28. A sufficient level of vacuum to effect transfer from carrier fabric 26 to transfer fabric 28 is applied through modulator means not shown to the web 30 via port 32 in transfer head 25. This vacuum also effects some water removal from web 30 after which the web is subjected to additional vacuum applied through ports 33, 34 and 35 on vacuum box 29 to achieve further dewatering of the web. The vacuum applied to ports 33, 34, and 35 may be individually modulated or modulated by a common means not shown. While not intending to thereby rigidly limit the present invention to such stated values, the angles of convergence C and divergence D of carrier fabric 26 and transfer fabric 28 are preferably in the order of about fifteen degrees or so, and the angular change 38 in the direction of carrier fabric 26 over surface 27 is preferably about ten degrees so that a vacuum seal is maintained across the slot in surface 27 of transfer head 25, and so that web 30 is not substantially compressively compacted in the transfer zone. Also, surface 27 is convexly curved downstream (i.e., in the direction fabric 28 traverses surface 27) with a relatively large radius (e.g., 8 inch radius or larger) to preclude high levels of paper web compression due to hoop stress induced by tension in fabric 26, and so disposed to obviate centrifugal force on web 30 as web 30 is forwarded past the transfer head 25.

FIG. 2 shows, in somewhat schematic form, an exemplary papermaking machine 21 for practicing the present invention. Papermaking machine 21 comprises transfer zone 20 as described hereinabove and, additionally: a forming section 41, an intermediate carrier section 42, a pre-dryer/imprinting section 43, a drying/creping section 44, a calender assembly 45, and reeling means 46.

The forming section 41, FIG. 2, of papermaking machine 21 comprises a headbox 50; a loop of fine mesh forming wire or fabric 51 which is looped about a vacuum breast roll 52, over vacuum box 53, about rolls 55 through 59, and under showers 60. Intermediate rolls 56 and 57, forming wire 51 is deflected from a straight run by a separation roll 62. Biasing means not shown are provided for moving roll 58 as indicated by the adjacent arrow to maintain fabric 51 in a slackobviating tensioned state.

Intermediate carrier section 42, FIG. 2, comprises a loop of carrier fabric 26 which is looped about rolls 62 through 69 and about an arcuate portion of roll 56. The loop of fabric 26 also passes over vacuum box 70, and transfer head 25; and under showers 71. Biasing means are also provided to move roll 65 to obviate slack in fabric 26 as was discussed above with respect to obviating slack in fabric 51. As is clearly indicated in FIG. 2, juxtaposed portions of fabrics 51 and 26 extend about an arcuate portion of roll 56, across vacuum box 70, and separate after passing over an arcuate portion of separation roll 62. Preferably, fabric 26 is identical to fabric 51 but for their lengths.

The pre-dryer/imprinting section 43, FIG. 2, of papermaking machine 21 comprises a loop of transfer fabric 28 which is alternatively referred to as an imprinting fabric. Fabric 28 is looped about rolls 77 through 86; passes across transfer head 25 and vacuum box 29; through a blow-through pre-dryer 88; and under showers 89. Additionally, means not shown are provided for biasing roll 79 towards the adjacent drying/creping cylinder 91 with a predetermined force per lineal inch (pli) to effect imprinting the knuckle pattern of fabric 28 in web 30 in the manner of and for the purpose disclosed in the hereinbefore referenced Sanford and Sisson patent; and biasing means not shown are provided for moving roll 85 as indicated by the adjacent arrow to obviate slack in fabric 28.

The drying/creping section 44, FIG. 2, of papermaking machine 21 comprises drying/creping cylinder 91 which is hereinafter alternatively referred to as Yankee 91, adhesive applicator means 92, and doctor blade 93. This portion of papermaking machine is shown in somewhat larger scale in FIG. 5 in order to clearly define certain angles with respect to the doctor blade 93 and its relation to Yankee 91. Accordingly, drying/creping section 44 is described more fully hereinafter concomitantly with discussing FIG. 5.

Still referring to papermaking machine 21, FIG. 2, it further comprises means not shown for independently controlling the velocities $V_1$ (of carrier fabric 26), $V_2$ (of transfer fabric 28 and Yankee 91), $V_3$ (of calender 45), and $V_4$ (of reeling means 46) in order to independently control the degree of wet-microcontraction precipitated in the transfer zone 20, the degree of dry-crepe, and the degree of residual dry-crepe as is more fully described hereinafter.

Figure 3:
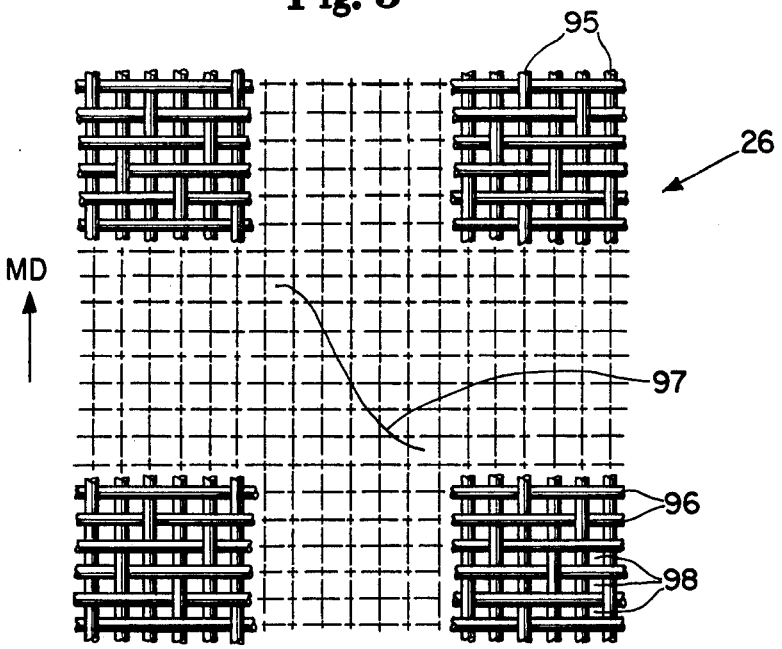
FIGS. 3 and 4 are fragmentary plan views of an exemplary forming wire/carrier fabric and an exemplary transfer/imprinting fabric, respectively, for use in the papermaking machine shown in FIG. 2.

FIG. 3 is an enlarged scale fragmentary plan view of an exemplary carrier fabric 26 and, preferably, of the forming fabric 51 of papermaking machine 21, FIG. 2. The specific fabric 26 shown in FIG. 3 comprises machine direction filaments 95 and cross-machine-direction filaments 96 which are woven together in a 5-shed satin weave using a non-numerically-consecutive warp pick sequence. This forms an open weave fabric having apertures 98. Such a fabric weave is described in U.S.

Pat. No. 4,239,065 and shown in FIG. 8 thereof. Filaments 95 and 96 are preferably polyester monofilaments. A typical papermaking fiber 97 having an approximate length of about two mm is shown superimposed on an exemplary fabric 26 having a mesh count of eighty-four machine direction filaments per inch (about 33 MD filaments per centimeter) and seventy-six cross-machine direction filaments per inch (about 30 CD filaments per centimeter). All of the filaments of the exemplary fabric 26 have nominal diameters of about seventeen-hundredths mm. Thus, papermaking fibers tend to lie substantially flat on such a fine mesh fabric when it is used as either a forming fabric or an intermediate carrier fabric; and apertures 98 facilitate water drainage as well as water removal via vacuum means.

Figure 4:
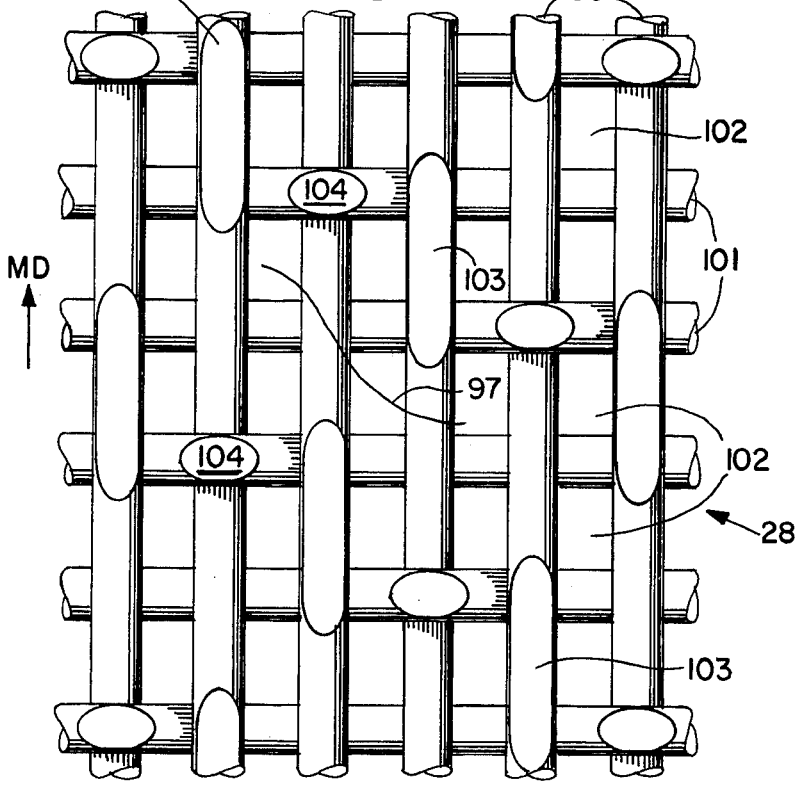

FIG. 4 is a fragmentary plan view of an exemplary transfer/imprinting fabric 28 of papermaking machine 21, FIG. 2. The scale of FIG. 4 is about the same as for FIG. 3 in order to clearly illustrate the relatively large apertures 102 (void spaces) of fabric 28 compared to the size of papermaking fiber 97, and thus make it readily apparent that such fibers can be deflected into the voids of such a coarse mesh, open weave transfer fabric. For instance, as shown, transfer fabric 28 has a mesh count of about twenty-four machine direction filaments 100 per inch (about 9.5 MD filaments per centimeter) and about twenty cross-machine direction filaments 101 per inch (about 7.9 CD filaments per centimeter). The filaments 100 and 101 of the exemplary transfer fabric 28 are preferably polyester, and have diameters of about six-tenths of a millimeter. As shown, transfer fabric 28 is also an open, 5-shed satin weave generated by using a nonnumerically-consecutive warp pick sequence (e.g., 1, 3, 5, 2, 4) as described in U.S. Pat. No. 4,239,065; and the top surface of fabric 28 has been sanded to provide flat eliptical-shape imprinting knuckles designated 103 and 104.

Figure 5:
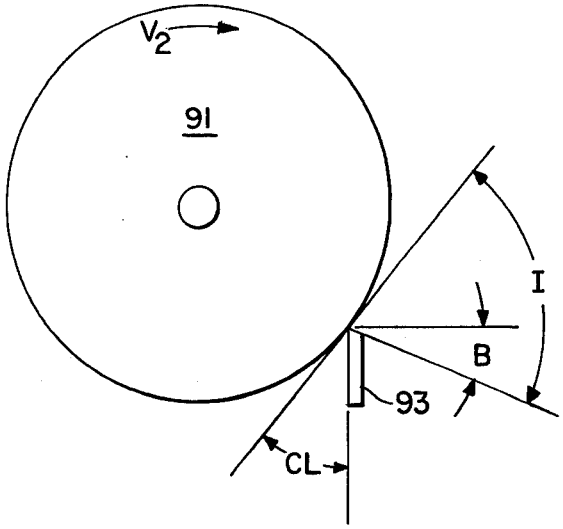
FIG. 5 is a fragmentary, enlarged scale, side elevational view of the creping-drying cylinder and creping blade portion of the papermaking machine shown in FIG. 2.

FIG. 5 is an enlarged scale view of the creping section of papermaking machine 21 in which the impact angle between Yankee 91 and doctor blade 93 is designated angle I, the bevel angle of doctor blade 93 is designated angle B, and the back clearance angle between Yankee 91 and doctor blade 93 is designate angle CL. Means not shown are provided for adjusting angle I. In general, creping of a paper web tends to disrupt bonds in the web. This causes the web to be softer but of lower tensile strength than were it not creped. These effects of creping can be altered somewhat by adjusting angle I: that is, increasing angle I will generally lessen the softening induced by creping and will generally lessen the creping induced reduction of tensile strength. Thus, increasing angle I will generally precipitate a paper web having greater tensile strength but less softness and dry end sheet control as compared to the paper web being produced prior to so increasing angle I. The optimum value for angle I will therefore depend on which is the more desirable product attribute: softness or tensile strength. This is particularly significant with respect to the present invention inasmuch as wet-microcontracting generally precipitates lower tensile strength and less softness but better dry end sheet control than dry-creping to achieve equally MD foreshortened paper webs, all other factors being equal. Indeed, substantially better dry-end sheet control can be achieved in hybrid paper wherein MD foreshortening is precipitated by a combination of wet-microcontracting and dry-creping as more fully described hereinafter with respect to discussing FIGS. 6 and 12.

A papermaking machine of the general configuration shown in FIG. 2 and designated therein as papermaking machine 21 was run under the following conditions in accordance with the present invention to produce paper embodiments of the present invention, as well as purely dry-creped paper. The forming fabric and the carrier fabric were polyester fabrics having mesh counts of seventy-eight of sixty MD/CD filaments per inch (about 30.7×23.6 filaments per centimeter), and were woven in four shed satin weaves wherein the warps (i.e., the machine direction filaments) alternately cross over one shute and under three shutes, and wherein the shutes alternately cross over three warps and under one warp. The curvature of surface 27 of transfer head 25 was an eight (8) inch (about 20 cm.) radius. The transfer/imprinting fabric 28 was of the mesh count and weave described hereinbefore with respect to fabric 28, FIG. 4: i.e., a 5-shed satin weave which had been woven with a non-numerically-consecutive warp pick sequence, and having a mesh count of twenty-four MD by twenty CD filaments per inch (about 9.4×7.9 filaments per centimeter). The furnish comprised fifty percent (50%) northern softwood kraft (NSK) (i.e., long papermaking fibers) and fifty percent (50%) hardwood sulfite (i.e., short papermaking fibers). A strength additive—namely Parez 631 NC—was added to the furnish at a rate of about 16.8 pounds per ton (about 8.4 gms/kg). Parez is a registered trademark of American Cyanamid. Polyvinyl alcohol creping adhesive was used and an impact angle I of eight-nine (89) degrees was maintained. A fiber consistency of about twelve-and-two-tenths percent (12.2%) was maintained at the couch roll 23 and a before-pre-dryer (hereinafter BPD) fiber consistency of about twenty-five percent (25%) was maintained. During the run, a constant velocity $V_1$ of about six hundred (600) feet per minute (about 183 meters per minute) was maintained for fabrics 51 and 26; a constant reel velocity $V_4$ of about four-hundred-fifty (450) feet per minute (about 137 meters per minute) was maintained; and no calendering was effected. The principal parameter varied during the run was $V_2$: the linear velocity of the transfer fabric 28 and the surface velocity of Yankee 91. $V_2$ was varied from $V_1$ to less than $V_4$: i.e., from six-hundred feet per minute (about 183 meters per minute) to four-hundred-twenty feet per minute (about 128 meters per minute). Also, the paper web was dried in the pre-dryer 88 to a fiber consistency of from about seventy to about seventy-five percent after the pre-dryer (hereinafter APD); and final dried on the Yankee to about ninety-eight or ninety-nine percent. The resulting paper had a basis weight of from about twenty-three-and-nine-tenths (23.9) to about twenty-five-and-six-tenths (25.6) pounds per three-thousand square feet (from about 39 to about 42 grams per square meter), and a dry caliper of from about nineteen-and-eight-tenths (19.8) mils (about 0.5 mm) to about twenty-three-and-four-tenths (23.4) mils (about 0.6 mm).

Figure 6:
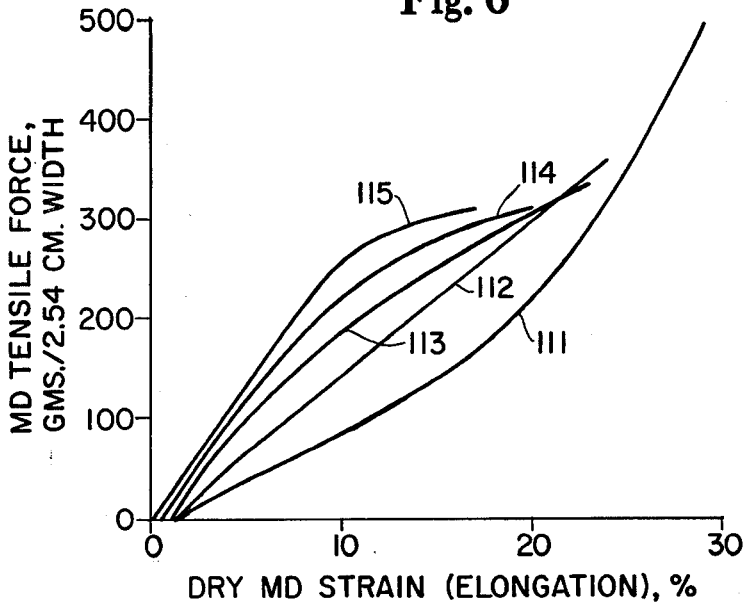

FIG. 6 is a graph of stress/strain data obtained from five dry samples of paper produced during the above described run of papermaking machine 21, FIG. 2. The values of $V_1$, $V_2$ and $V_4$ are tabulated in Table I for each designated curve on FIG. 2. The percent wet-microcontraction (WMC) listed in Table I was computed by dividing the difference between $V_1$ and $V_2$ by $V_1$; the percent dry crepe was computed by dividing the difference between $V_2$ and $V_4$ by $V_2$. The overall MD foreshortening was computed by dividing the difference between $V_1$ and $V_4$ by $V_1$.

TABLE I

| Curve Nos. FIGS. 6 & 7 | VELOCITIES Feet/minute $V_1$ | (meters/minute) $V_2$ | $V_4$ | WMC | Dry-Crepe | Overall MD Fore-Short-ening |
|---|---|---|---|---|---|---|
| 111/111W | 600(183) | 600(183) | 450(137) | 0 | 25% | 25% |
| 112/112W | 600(183) | 510(155) | 450(137) | 15% | 13% | 25% |
| 113/113W | 600(183) | 480(146) | 450(137) | 20% | 7% | 25% |
| 114/114W | 600(183) | 450(137) | 450(137) | 25% | 0 | 25% |
| 115/115W | 600(183) | 420(128) | 450(137) | 30% | −7% | 25% |

Parenthetically, the stress/strain data and resulting moduli presented in FIGS. 6–8, 12–15, 17 and 18, and as used herein were obtained by testing samples having gage lengths of four inches (about 10 cm) and which were one inch (2.54 cm.) wide by applying and recording tensile force in the machine-direction (MD) of the samples in an apparatus which stretched the samples at a rate of about four inches per minute (about 10 cm. per minute). Thus, whereas stress per se is force per unit of cross-sectional area, the graphed stress data are presented in grams force per unit of sample width. Also these stress/strain graphs were derived from testing several replicate samples—generally four—and averaging the data therefrom. Therefore, data points per se are not indicated on the graphs.

Still referring to FIG. 6, curve 111 was derived from 25% purely dry-creped paper, and curve 111 is highly upwardly concave which reflects the relative ease (low tensile values) of pulling out dry-crepe induced stretch until the available stretch in the paper is largely removed after which the slope of curve 111 increases sharply. By way of contrast, the curves 112 through 115 have distinctly different characters: i.e., shapes. That is, curve 112 has a generally linear character and curves 113 through 115 are reversely curved compared to curve 111. Thus, the hybrid paper samples of curves 112 and 113—paper which has been both wet-microcontracted and dry-creped—as well as the purely wet-microcontracted samples of curves 114 and 115 have distinctly different characters from the purely dry-creped paper of Curve 111. These character differences are believed to be relatively great due to the relatively low fiber consistency of the paper web at the time it was transferred from carrier fabric 26 to transfer fabric 28: i.e., twelve-and-two-tenths percent (12.2%) fibers by weight measured at couch 23.

Still referring to FIG. 6, the higher stress/strain values through the low and/or moderate ranges of elongation of curves 112 through 115 as compared to curve 111 manifest why better sheet control can be maintained while reeling and/or converting the pure and hybrid WMC paper webs than purely dry-creped webs because higher tension can be maintained on them without substantially vitiating their MD stretch.

Figure 7:
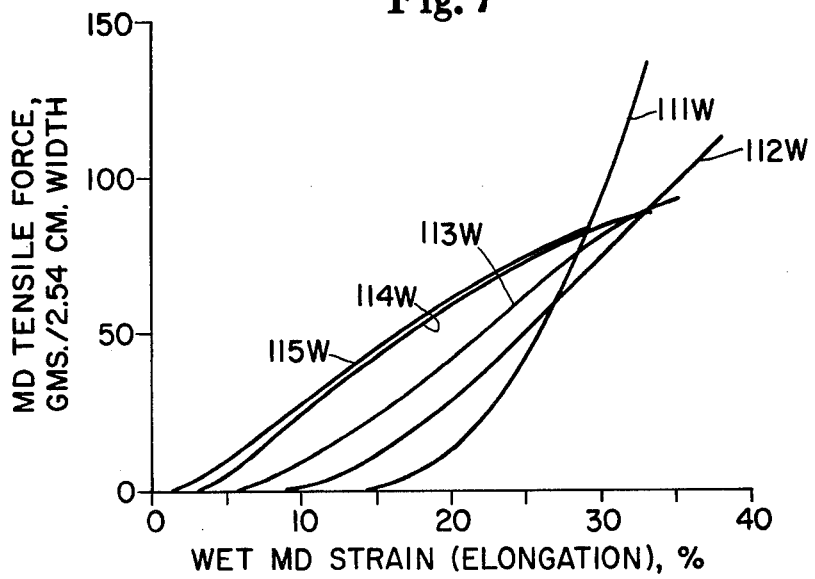

FIG. 7 is a graph of MD stress/strain data obtained from wet samples of paper which were produced as stated above and described in conjunction with describing FIG. 6. That is, curves 111W through 115W are, respectively, derived from wet samples of the paper which precipitated curves 111 through 115 in FIG. 6, above. The hybrid samples have stress/strain curves (112W and 113W) which are substantially less concave upwardly than curve 111W: the curve for dry-creped paper. Also, the curves for the purely wet-microcontracted samples (curves 114W and 115W) are of a different character from curve 111W: that is, curve 111W is upwardly concave whereas curves 114W and 115W are upwardly convex. Such differences in the relative values and characters of the wet stress/strain curves of hybrid and pure wet-microcontracted paper (hereinafter WMC paper) as compared to purely dry-creped paper makes such WMC paper especially useful as a ply of multi-ply tissue products wherein the plys have substantially identical elongations at rupture, but substantially non-identical stress/strain curves. Such paper products wherein the plies are discontinuously adhered together manifest monomodal stress/strain characters due to their matched elongations at rupture; manifest additive ply strengths throughout their strain domains; and have high liquid absorbency. For example, consider a discontinuously bonded two-ply product comprising a ply of WMC paper and a ply of purely dry-creped paper. If an unconstrained dry-creped tissue is wetted, crepe induced stresses are relieved and the creped tissue elongates in the plane of the paper as some of the crepe folds are floated out. However, when such a creped tissue is a ply of a multi-ply product in which another ply constrains unadhered portions of the creped ply from being elongated in the plane of the paper when wetted, but does not otherwise constrain such portions of the creped ply, at least some of those portions of the creped ply will pucker. This assumes that such product remains substantially unstressed as wetting thereof is effected. Such puckering enhances the wet bulk and caliper of the product as well as its overall liquid absorbency. In general, WMC tissue paper will act as such a constrainer for dry-creped tissue paper when they are discontinuously adhered or bonded together to make a multi-ply product. Also, WMC paper having zero dry-crepe can be such a constrainer for hybrid WMC/dry-creped paper; and hybrid WMC/dry-creped paper can be such a constrainer for purely dry-creped paper (i.e., dry-creped paper having no degree of WMC).

Additional examples of making paper embodiments of the present invention (i.e., pure and hybrid WMC paper) have been made and are hereinafter described to illustrate, for instance, the fact that the present invention may be practiced on a wide variety of papermaking machines, and to illustrate a variety of control parameters with which the level, and shape of the stress/strain modulus of WMC paper can be tailored to provide parametrically optimized end products: e.g., a WMC paper web having such a stress/strain modulus that, when incorporated in a 2-ply tissue paper product along with a purely dry-creped ply, the product manifests good absorbency and a monomodal stress/strain property. Note: as used herein, a monomodal stress/strain property is defined as a stress/strain curve having only one peak whereas a product comprising discontinuously adhered plies having substantial strengths albeit unmatched ultimate elongations at rupture will have stress/strain curves having two or more peaks. Note also that pure WMC paper web and hybrid WMC paper web can also have matched elongations at rupture yet have sufficiently different stress/strain properties that they can be combined to form a product which will also pucker when wetted (and thus have high liquid absorbency), and manifest a strength efficient monomodal stress/strain property. This is, however, not intended to imply that a monomodal stress/strain property is required to achieve the puckering precipitated absorbency benefit. Rather, matching the plies to achieve a monomodal stress/strain property precipitates strength and energy absorption efficiency in such multi-ply tissue paper products in addition to providing the puckering absorbency benefit.

Figure 8:
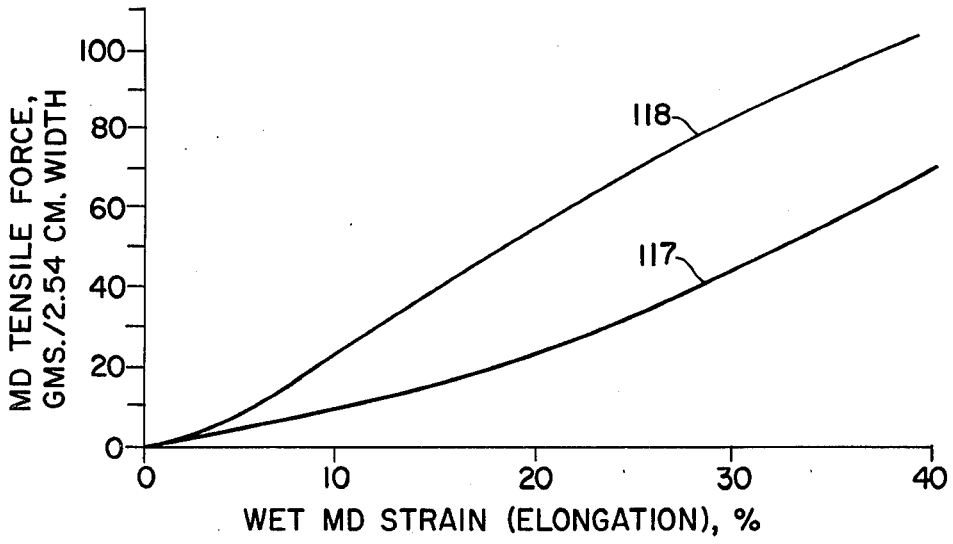
FIGS. 6 through 8 are graphical representations of parametric relationships pertaining to the present invention as practiced in a papermaking machine of the configuration shown in FIG. 2.

FIG. 8 comprises graphed stress/strain data derived from testing additional wet samples of WMC paper produced on a papermaking machine of the geometry shown in FIG. 2 to illustrate the transfer fabric mesh count impact on the stress/strain property of the WMC paper. Essentially, two runs were made under substantially identical conditions but for the mesh of the transfer/imprinting fabric 28, to wit: curve 117 was derived from paper made while a transfer fabric 28 having a mesh count of thirty-six MD filaments per inch (about 14/cm) by thirty-two CD filaments per inch (about 12.6/cm) was on papermaking machine 21; and curve 118 was derived from paper made while a transfer fabric 28 having a mesh count of sixty-four MD filaments per inch (about 25.2/cm) by fifty-four CD filaments per inch (about 21.3/cm) was on the papermaking machine. Both were of the weave shown in FIG. 4. Thus, all other things being equal, the stress/strain modulus of WMC paper is directly related to the mesh count of the transfer fabric: i.e., a finer mesh precipitates a higher stress/strain modulus and vice versa. It is, however, not intended to thereby imply that finer mesh fabrics precipitate the best results from the present invention. What is best depends on what product attributes are important. Indeed, while the fine-mesh-fabric curve 118 is higher than the coarse-mesh-fabric curve 117 in FIG. 8, the 118 paper had a substantially smaller caliper (i.e., 10.9 [0.277] v. 14.1 [0.358] mils [mm] for the 117 paper) and thus lower bulk. Accordingly, bulk is enhanced by using coarser transfer fabrics whereas strength is enhanced by using finer transfer fabrics.

Still referring to FIG. 8, the paper samples were made using a furnish comprised solely of northern softwood kraft (relatively long papermaking fibers). The papermaking machine was run with a velocity $V_1$ of six-hundred feet per minute (about 183 meters per minute) and transfer fabric velocity $V_2$ of four-hundred-eighty feet per minute (about 146 meters per minute) to achieve twenty percent (20%) WMC. The couch consistency was about sixteen-and-one-half percent for the 117 curve paper, and about thirteen-and-nine-tenths percent for the 118 curve paper. As the paper was being forwarded on fabric 28, FIG. 2, from the pre-dryer 88 to the Yankee 91, the zones of the paper juxtaposed the knuckles of fabric 28 were impregnated with a latex binder material by a rotogravure-type applicator, not shown in FIG. 2. The quantities of latex solids for the papers of curves 117 and 118 were forty-four-hundredths and sixty-hundredths pounds, respectively, per three-thousand-square feet (about 0.72 gms. and 0.98 gms. per square meter). The paper produced had a basis weight when reeled in the range of about seventeen to about eighteen pounds per three-thousand-square-feet (from about 27.6 to about 29.3 grams per square meter), and was lightly calendered at about twelve pounds per lineal inch (pli) (about 2.15 kg per lineal centimeter). Although the paper was parted from the Yankee 91 with a doctor blade 93 set at an impact angle I of eighty-four degrees, the paper had no substantial degree of residual dry-crepe because it was reeled at the same velocity as the velocity of the Yankee 91: i.e., $V_4=V_2$.

Figure 9:
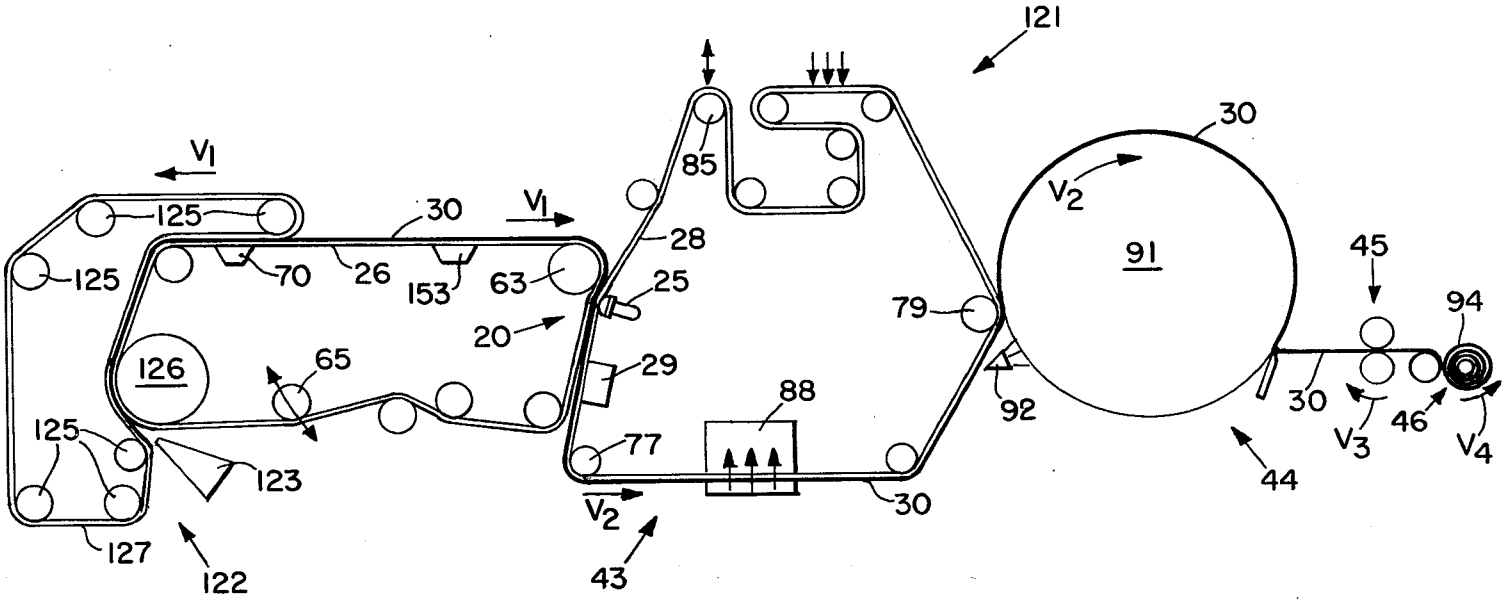
FIG. 9 is a somewhat schematic, side elevational view of a 3-loop, twin-wire-former (TWF) type papermaking machine in which the method of the present invention may be practiced.

FIG. 9 shows a twin-wire-former (TWF) type papermaking machine 121 with which the present process invention can be practiced to produce paper embodiments of the present invention. As compared to papermaking machine 21, FIG. 2, papermaking machine 121 comprises a twin-wire-former section 122 rather than a fixed roof former. Insofar as the present invention is concerned, the transfer zone 20 of both machines are preferably identical, as are their pre-dryer/imprinting sections 43, their drying/creping sections 44, their calender sections 45, and their reeling sections 46. Thus, these sections and their corresponding components are identically numbered albeit some of the components numbered in FIG. 2 are not numbered in FIG. 9 to avoid undue redundancy.

The twin-wire-former section 122 of papermaking machine 121, FIG. 9, comprises an endless foraminous forming fabric 127 which is looped about a plurality of guide rolls 125; and an endless, foraminous carrier fabric 26 which is looped about the forming roll 126 and through the transfer zone 20 as shown. Essentially, fabrics 26 and 127 synchronously converge adjacent a headbox 123 from which a jet of aqueous papermaking furnish issues. Primary dewatering occurs through the portion of fabric 127 wrapped about forming roll 126, and subsequent dewatering is assisted by transfer vacuum box 70 and vacuum box 153 to provide a predetermined fiber consistency of the web 30 as it is forwarded on fabric 26 to the transfer zone 20. Insofar as the present invention is concerned, papermaking machine 121 is operated like papermaking machine 21, FIG. 2, and is primarily presented in FIG. 9 because it was used to make paper samples from which data were derived and plotted on the graphs presented in FIGS. 10 through 15, inclusive. It is not intended, however, to thereby imply that the present invention is limited to papermaking machines having identical transfer zones.

Figure 10:
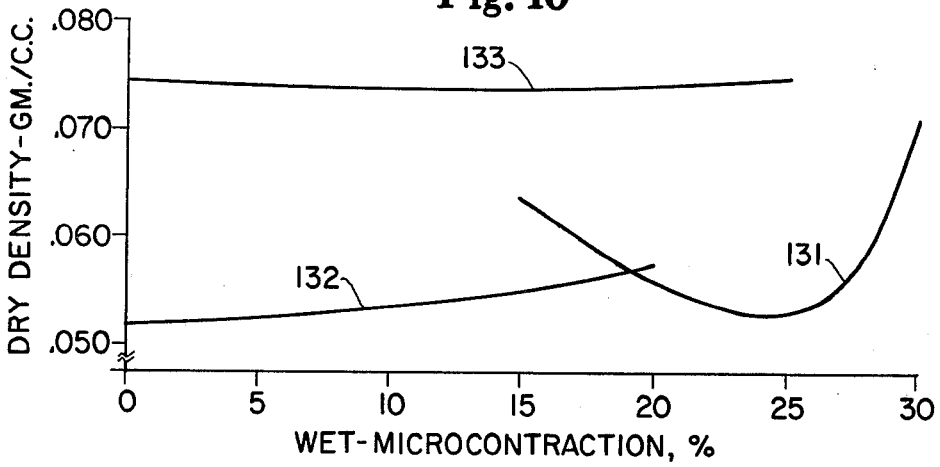
FIGS. 10 and 11 are mixed graphical representations of parametric relationships pertaining to the present invention as practiced in papermaking machines of the configurations shown in FIGS. 2 and 9.

FIG. 10 is a graph comprising curves 131, 132 and 133 of dry density data versus percent WMC of a mix of paper samples produced on papermaking machines of the configurations shown in FIGS. 2 and 9. The samples from which curve 131 was derived were purely wet-microcontracted albeit removed from the Yankee 91 by doctor 93. That is, any dry-crepe which was induced in the webs by doctor 93 was pulled out of the webs by running the reel at the Yankee velocity: i.e., $V_4=V_2$. These samples had nominal basis weights of about eighteen (18) pounds per three-thousand (3000) square feet (about 29.3 gms/sq. meter); and were made using a transfer fabric 28 of the weave shown in FIG. 4 and a mesh count of twenty-four MD filaments per inch (about 9.4/cm) by twenty (20) CD filaments per inch (about 7.9/cm), all of the filaments having a diameter of about six-tenths (0.6) mm. The rise of curve 131 at values of WMC is excess of twenty-five (25) percent is believed to be a manifestation of the fibers of the web overcrowding the voids of fabric 28 and precipitating some macrofolding of the web inasmuch as a significant degree of undesirable macrofolding induced hard ridges were visible in paper samples made at thirty (30) percent WMC: i.e., $(V_1-V_2)/V_1=0.3$.

Macrofolding is hereby defined as causing a low-fiber-consistency web to fold in such a manner that adjacent machine direction spaced portions of the web become stacked on each other in the Z-direction of the web, whereas wet-microcontracting as defined herein is intended to be wet-end machine-direction-foreshortening which is effected in such a manner that macrofolding is substantially precluded.

Still referring to FIG. 10, curves 132 and 133 were derived from families of samples which families were machine-direction foreshortened twenty percent and twenty-five percent, respectively, and which had basis weights of about eighteen and twenty-five pounds per three-thousand-square feet respectively, (about 29.3 grams and 40.7 grams per square meter, respectively). For example, to make a sample for curve 132 having twenty percent machine-direction foreshortening (i.e., $(V_1-V_4)/V_1=20\%$) which was wet-microcontracted only ten percent (i.e., $(V_1-V_2)/V_1=10\%$), it had to be dry-creped to provide the other ten percent machine-direction foreshortening. Thus, to make the family of samples from which curve 132 was derived, $V_4$ was maintained constant at eighty percent of the value of $V_1$, and $V_2$ was incremented from $V_1$ to $V_4$. Similarly, for curve 133, $V_4$ was maintained constant at seventy-five percent of the value of a constant value of $V_1$ (e.g., 600 feet per minute), and $V_2$ was varied from the value of $V_1$ to the value of $V_4$.

Significantly all of the paper samples from which curves 131, 132 and 133 of FIG. 10 were derived manifest low density (high bulk) as compared to conventional wet-felt-pressed papers. Moreover, curve 131 (purely WMC paper) manifests a decreasing dry density up to about twenty-five percent foreshortening after which the density increase is believed to be a manifestation of macrofolding, whereas curve 132 (samples having the same basis weight as for curve 131) manifests a slightly increasing dry density as the WMC portion of the constant overall twenty-percent machine direction foreshortening is increased. Also, curve 133 which was derived from samples of heavier basis weight and greater machine direction foreshortening (i.e., 25%) than for curve 132 manifests a substantially constant dry density as the WMC portion of the total twenty-five percent direction foreshortening is varied from zero to the full twenty-five percent.

Figure 11:
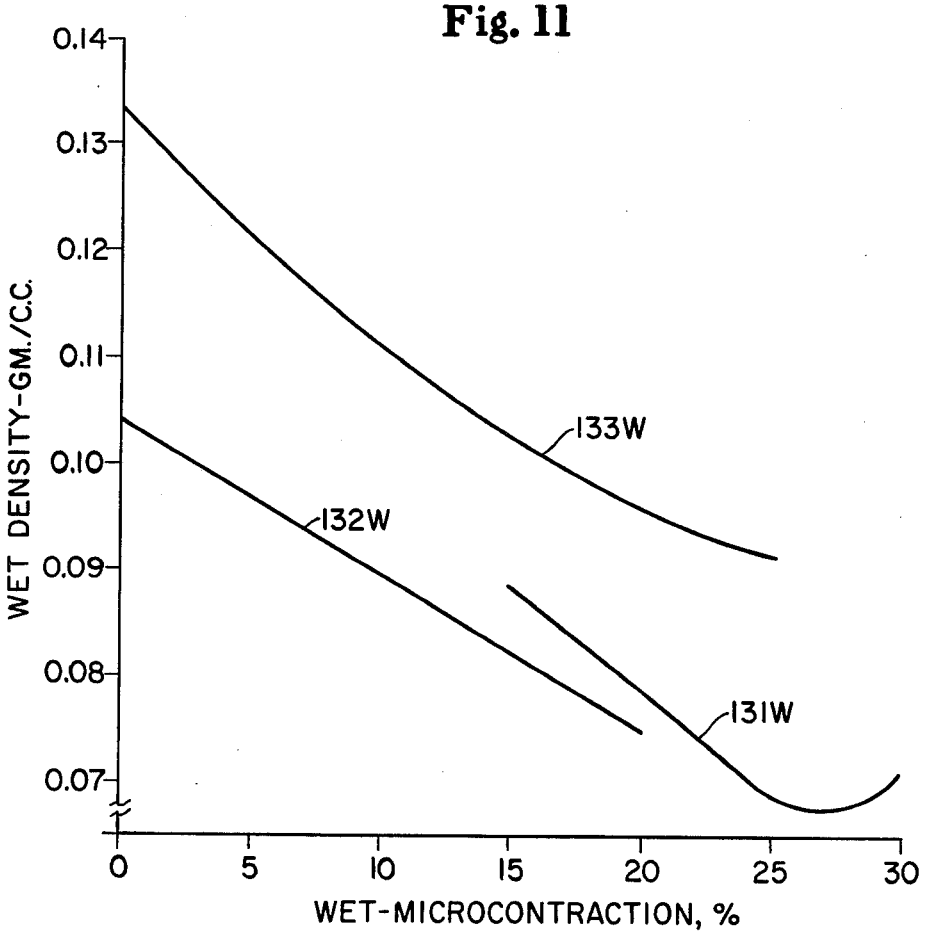

Referring now to FIG. 11, curves 131W, 132W, and 133W were derived from wet samples of the same respective paper samples from which curves 131, 132, and 133 of FIG. 10 were derived. Curves 131W, 132W, and 133W all manifest relatively low wet densities and, very importantly with respect to the present invention, all manifest an inverse relationship of wet density to percent WMC at least up to the nadir of curve 131W at which the foregoing described macrofolding phenomenon became manifest.

Figure 12:
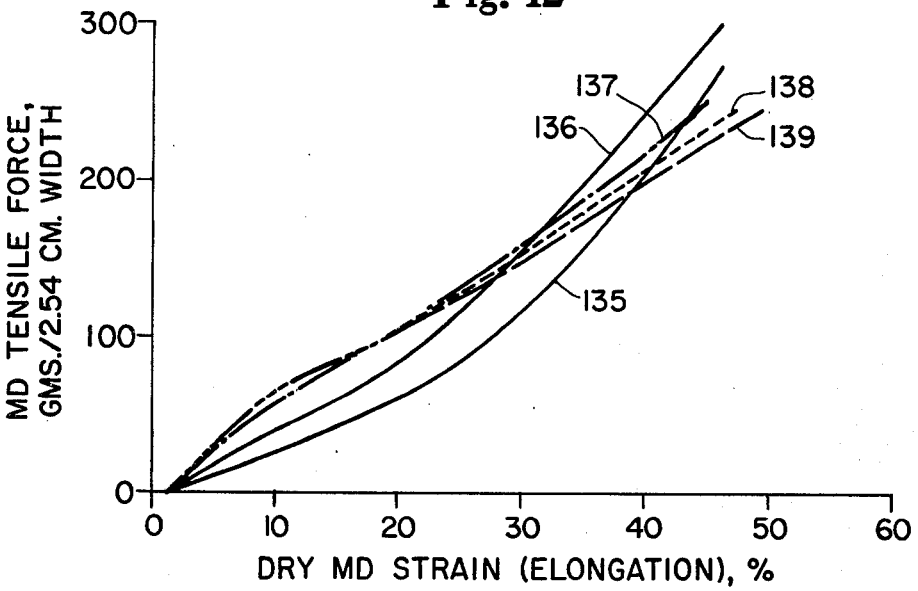
FIGS. 12 through 15 are graphs of parametric relationships pertaining to the present invention as practiced in a papermaking machine of the configuration shown in FIG. 9.
Figure 13:
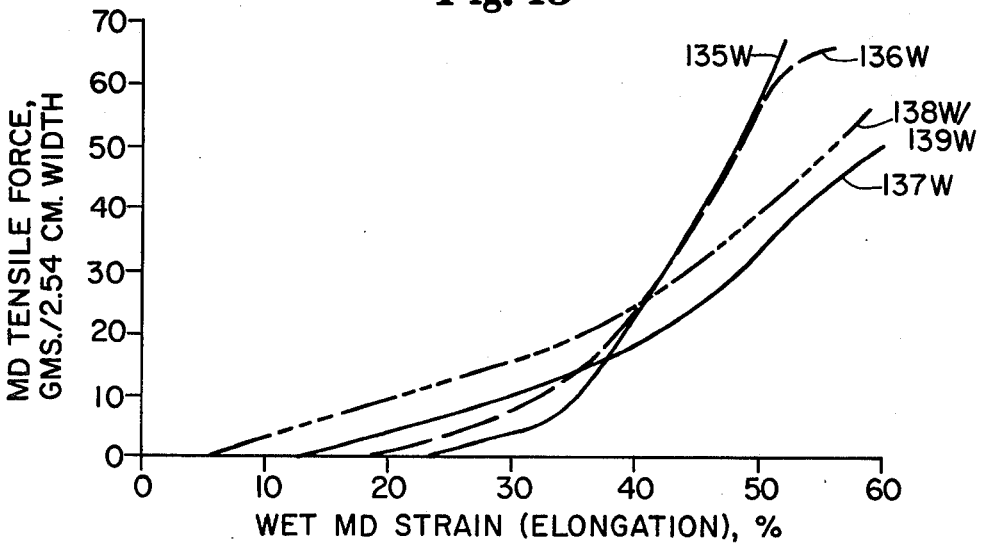

FIGS. 12 and 13 are dry and wet density curves, respectively, derived from data obtained from families of samples which were substantially identically made as the samples from which the curves of FIGS. 6 and 7 were derived except for their basis weight, and for their percent fiber consistencies by weight at the point of their differential velocity transfers. For FIGS. 6 and 7, the fiber consistency at couch 63 was maintained at about twelve-and-two-tenths percent (12.2%), and for FIGS. 12 and 13 it was maintained at about twenty-one-and-one-half percent (21.5%).

The basis weights for FIGS. 6 and 7 were about twenty-five pounds per three-thousand square feet (about 40.7 grams per square meter) and for FIGS. 12 and 13 were about eighteen pounds per three-thousand square feet (about 29.3 grams per square meter). These comparative data manifest much greater differences between WMC paper and purely dry creped paper for the FIGS. 6 and 7 samples derived at the lower fiber consistency (12.2%) than for the FIGS. 12 and 13 samples derived at the higher fiber consistency (21.5%) at transfer. Albeit the preferred range of fiber consistency of transfer is from about ten to about thirty percent, the more preferred range is from about ten to about twenty percent, and the most preferred range is from about ten to about fifteen percent.

Velocity and MD foreshortening data for the samples from which the curves of FIGS. 12 and 13 were derived are presented in Table II. These data also indicate that some WMC can be pulled out of the samples by reeling the paper faster at a velocity $V_4$ which is greater than the Yankee velocity $V_2$; it does not shift the stress/-strain further upward and to the left as was the case at the lower level of fiber consistency at transfer. That is, compare the displacement of curve 115 relative to curve 114, FIG. 6, to the virtual non-displacement of curve 139 relative to curve 138, FIG. 12.

TABLE II

| Curve Nos. FIGS. 12 & 13 | VELOCITIES Feet/minute $V_1$ | (meters/minute) $V_2$ | $V_4$ | WMC | Dry-Crepe | Overall MD Fore-Short-ening |
|---|---|---|---|---|---|---|
| 135/135W | 800(244) | 800(244) | 560(171) | 0 | 30% | 30% |
| 136/136W | 800(244) | 705(215) | 560(171) | 12 | 21 | 30% |
| 137/137W | 800(244) | 620(189) | 560(171) | 22 | 10 | 30% |
| 138/138W | 800(244) | 560(171) | 560(171) | 30% | 0 | 30% |
| 139/139W | 800(244) | 520(158) | 560(171) | 35% | −8% | 30% |

Figure 14:
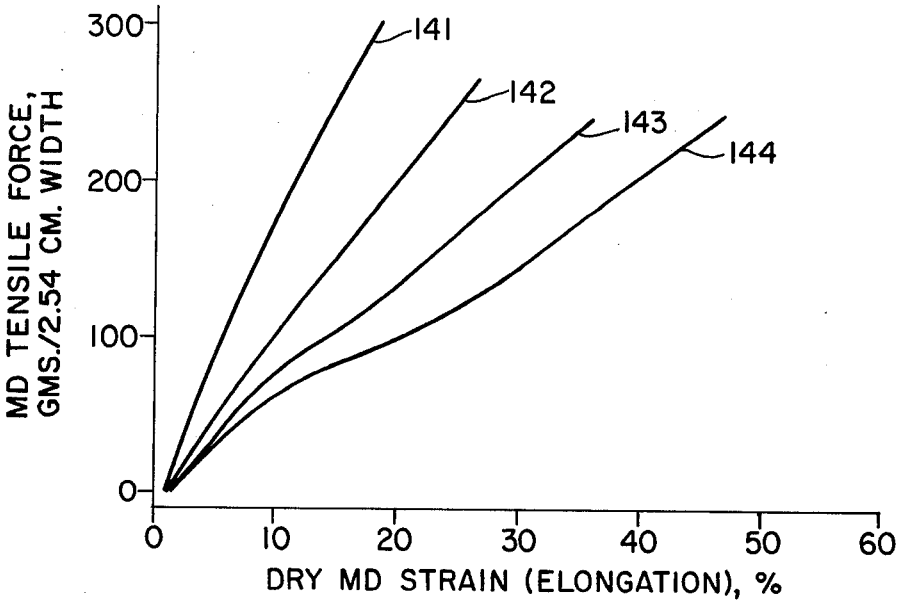
Figure 15:
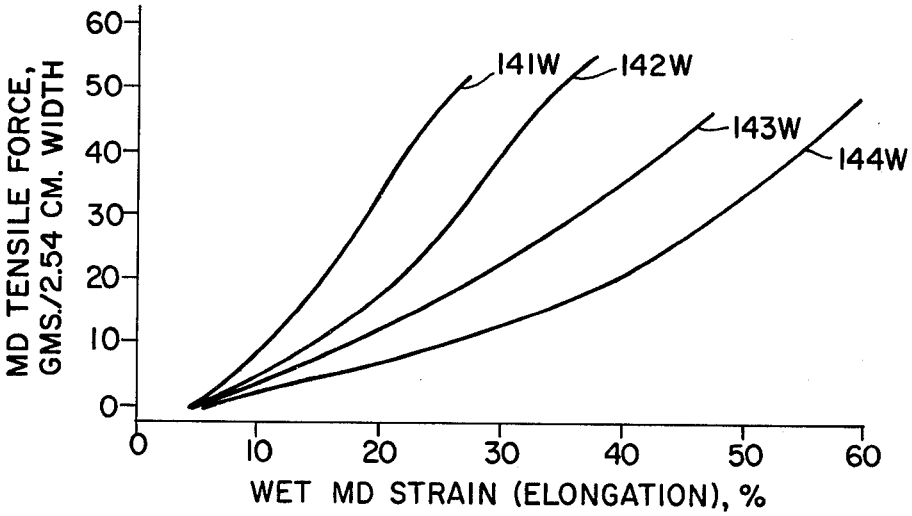

FIGS. 14 and 15 are graphs upon which the curves were derived from dry and wet samples, respectively, having different levels of wet-microcontraction ranging from fifteen to thirty percent in five percent (5%) increments. Briefly, the samples from which these data were derived were run to illustrate how the elongation at rupture of WMC paper can be tailored by controlling the degree of WMC. The data tabulated in Table III taken in conjunction with that graphed in FIGS. 14 and 15 clearly indicate that the elongation at rupture (i.e., the percent strain at which a sample breaks and thus the end point of each of the curves) is directly related to the degree of WMC.

TABLE III

| Curve Nos. FIGS. 14 & 15 | VELOCITIES Feet/minute (meters/minute) $V_1$ | $V_2$ | $V_4$ | WMC | Dry-Crepe | Overall MD Fore-Short-ening |
|---|---|---|---|---|---|---|
| 141/141W | 800(244) | 68O(207) | 680(207) | 15% | 0 | 15% |
| 142/142W | 800(244) | 640(195) | 640(195) | 20% | 0 | 20% |
| 143/143W | 800(244) | 600(183) | 600(183) | 25% | 0 | 25% |
| 144/144W | 800(244) | 560(171) | 560(171) | 30% | 0 | 30% |

Figure 16:
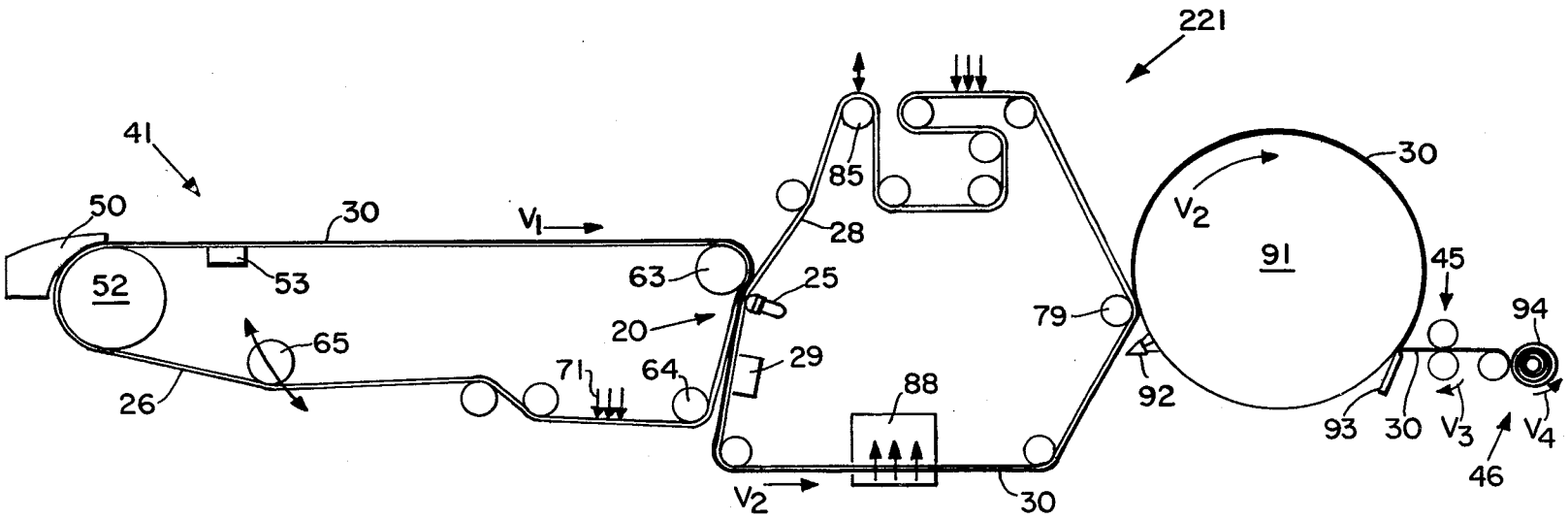
FIG. 16 is a somewhat schematic, side elevational view of another papermaking machine in which the method of the present invention may be practiced.

FIG. 16 is a side elevational view of another papermaking machine 221 in which the present invention may be practiced, and in which the corresponding elements are identically designated to the elements of papermaking machine 21, FIG. 2. Insofar as the present invention is concerned, papermaking machine 221 is operated in the same manner as papermaking machine 21: that is, the paper web 30 undergoes a differential velocity, relatively non-compacting transfer from fabric 26 to fabric 28 while the fiber consistency of the web is relatively low. The low fiber consistency and the relative absence of compacting forces enables substantial machine-direction foreshortening of the web without substantial compaction of the web. A principal purpose of showing papermaking machine 221 is because the data plotted on the graphs of FIGS. 17 and 18 were obtained from tissue paper samples which were made on a papermaking machine of that geometry.

Figure 17:
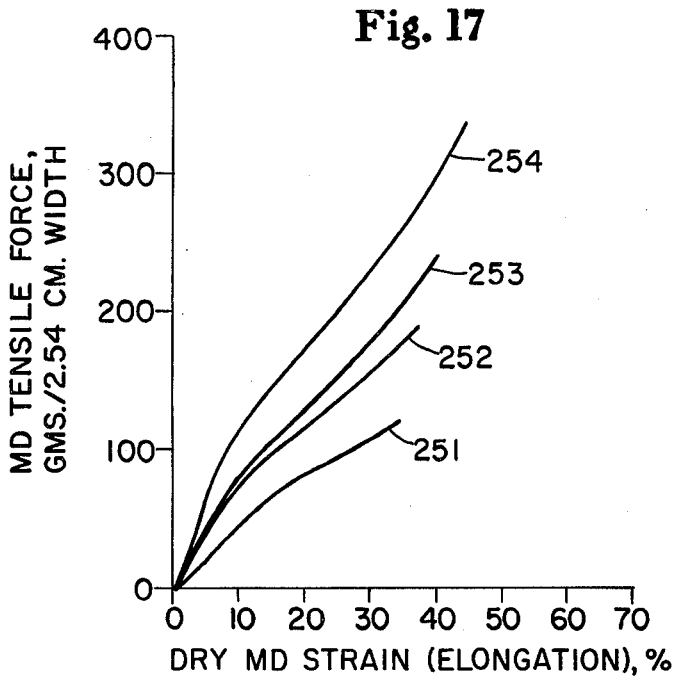
FIGS. 17 and 18 are graphs of stress/strain relationships of tissue paper embodiments of the present invention which paper was made through the use of a papermaking making machine of the configuration shown in FIG. 16.
Figure 18:
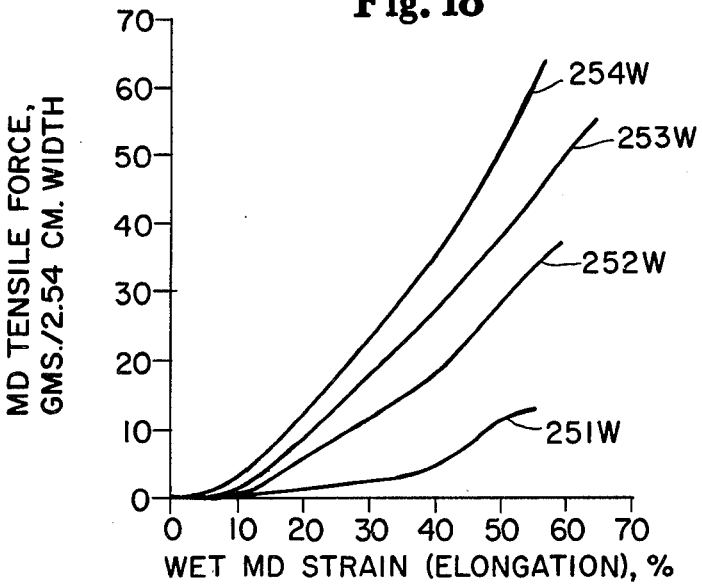

FIGS. 17 and 18 are graphs upon which the curves were derived from dry and wet samples, respectively, which were made on a papermaking machine 221, FIG. 16. Briefly, these samples were run to derive exemplary data to illustrate how the stress at rupture (i.e., the breaking-point stress for each sample) can be tailored in WMC paper by the inclusion of strength additives in the furnish. All of the samples were made from a furnish wherein the fibers were northern softwood kraft; formed at eight-hundred feet per minute (about 244 meters per minute) on a forming fabric 26 having a mesh count of eighty-four by seventy-six filaments per inch (about 33×30 per centimeter) and of the weave shown in FIG. 3; transferred to an imprinting fabric 28 traveling at about six-hundred feet per minute (about 183 meters per minute), and having a mesh count of thirty-six by thirty-two filaments per inch (about 14×13 per centimeter), and of the weave shown in FIG. 4; so transferred at a fiber consistency of from about eighteen to about twenty-one percent; and reeled at the same velocity as the imprinting fabric 28. Parez was added to the furnish in the following quantities: curve 251, zero; curve 252, two-and-nine-tenths (2.9) pounds per ton of fibers (about 1.45 grams per kilogram); curve 253, seven-and-one-tenth pounds per ton of fiber (about 3.55 grams per kilogram); and for curve 254, about fifteen pounds per ton of fibers (about 7.5 grams per kilogram).

By way of recapping, the data included herein manifests: the bulk—especially wet bulk—of WMC paper is directly related to the void volume of the transfer (receiving) fabric and thus is inversely related to the mesh count of the transfer fabric albeit the strength is directly related to the mesh count of the transfer fabric; the strain at rupture of WMC paper is directly related to the degree of WMC; the stress at rupture of WMC paper is directly related to the strength properties of the furnish (albeit this is not intended to preclude providing additional strength by applying strengthening materials to the webs per se); the character of the stress/strain property of WMC paper is directly related to the portion of machine-direction foreshortening which is imparted by wet-microcontacting per se and upon the fiber consistency of the web when it undergoes the differential velocity transfer; and, in general, evidences that the present invention can be used to make high bulk/low density WMC paper over a broad spectrum of process conditions. It is, however, not intended to thereby limit the scope of the present invention. Moreover, although all of the presented data were obtained through the use of papermaking machines having creping means, it is also not intended to thereby limit the scope of the present invention.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. A process for making high bulk, MD-extensible tissue paper having a predetermined MD stress/strain modulus substantially different from comparably extensible dry-creped paper, said MD stress/strain modules being substantially greater than for said comparably extensible dry-creped paper through their lowest one-third ranges of MD extensibility, said process comprising the steps of:

forming an embryonic paper web from an aqueous fibrous papermaking furnish;

forwarding said embryonic web at a first velocity on an endless carrier fabric to a transfer zone;

non-compressively removing sufficient water from said embryonic web that it has a fiber consisting of from about ten (10) to about thirty (30) percent immediately prior to its reaching said transfer zone to enable said embryonic web to be transferred to an endless foraminous transfer fabric at said transfer zone, said transfer fabric having a sufficiently greater void volume than said carrier fabric to obviate macrofolding of said web;

forwarding at a second velocity said endless foraminous transfer fabric along a looped path in contacting relation with a transfer head disposed at said transfer zone, said transfer head having a convex fabric-contacting surface, said second velocity being substantially less than said first velocity;

guiding said carrier fabric and said transfer fabric to cause them to converge and then diverge at acute angles while traversing said convex surface, said acute angles being sufficiently small and the curvature of said convex surface being sufficiently large to substantially obviate fabric-tension-induced compaction of said embryonic web as it passes through said transfer zone;

applying only a sufficient level of differential gaseous pressure across said embryonic web at said transfer zone to cause said embryonic web to transfer to said transfer fabric in said transfer zone without precipitating substantial compaction of said embryonic web; and completing the papermaking-machine drying of said embryonic web while maintaining the macroscopic interfiber relationships therein in the plane of the web and without overall mechanical compaction of the web.

2. The process for making high bulk, MD-extensible tissue paper of claim 1 wherein said fiber consistency is in the range of from about ten (10) to about twenty (20) percent immediately prior to said transfer.

3. The process for making high bulk, MD-extensible tissue paper of claim 1 wherein said fiber consistency is in the range of from about ten (10) to about fifteen (15) percent immediately prior to said transfer.

4. The process for making high bulk, MD-extensible tissue paper of claim 1 wherein said transfer fabric is of the open weave type and has a mesh count of from about four (4) to about thirty (30) filaments per centimeter in both the machine-direction (MD) and the cross-machine-direction (CD) of said fabric.

5. The process for making high bulk, MD-extensible tissue paper of claim 4 wherein said mesh count is from about six (6) to about fifteen (15) filaments per centimeter in both the MD and CD directions of said fabric.

6. The process for making high bulk, MD-extensible tissue paper of claim 1 wherein the velocity of said transfer fabric is from about ten (10) to about forty (40) percent slower than said predetermined velocity of said carrier fabric.

7. The process for making high bulk, MD-extensible tissue paper of claim 1 wherein the velocity of said transfer fabric is from about fifteen (15) to about thirty (30) percent slower than said predetermined velocity of said carrier fabric.

8. The process of claim 1, 4, or 6 further comprising the step of adding sufficient wet strength material for said web to be an effective and durable spill wipe-up article.

9. The process of claim 8 wherein at least a substantial portion of said wet strength material is included in the furnish from which said web is formed.

10. The process of claim 8 wherein at least a substantial portion of said wet strength material is discontinuously applied to said web after its formation.

11. The process of claim 1, 4, or 6 further comprising the steps of:

adhesively securing said web to a creping cylinder having a surface velocity substantially equal to the velocity of said transfer fabric; and dry-creping said web from said creping cylinder with a doctor blade.

12. The process of claim 11 further comprising the step of reeling said web at a velocity at least about equal to the surface velocity of said creping cylinder to substantially remove dry-creping induced extensibility therefrom.

13. The process of claim 11 further comprising the step of reeling said web at a sufficiently slower velocity than the surface velocity of said creping cylinder that said web has a predetermined degree of residual dry-crepe whereby a hybrid stress-strain modulus is imparted to said web which is manifested by the web acting somewhat like a dry-creped web at low stress levels when wet, and the web having a substantially higher stress/strain modulus through its middle one-third range of MD extensibility than a purely dry-creped web which is otherwise substantially identical and has substantially equal ultimate MD extensibility.

14. The process of claim 11 further comprising the step of adding sufficient wet strength material for said web to be an effective and durable spill wipe-up article.

15. The process of claim 14 wherein at least a substantial portion of said wet strength material is included in the furnish from which said web is formed.

16. The process of claim 14 wherein at least a substantial portion of said wet strength material is discontinuously applied to said web after its formation.

17. The process of claim 1 wherein said embryonic web is dewatered to a fiber consistency of from about ten (10) to about twenty (20) percent immediately prior to being transferred to said transfer fabric, said transfer fabric having a mesh count of from about six (6) to about fifteen (15) filaments per centimeter in both the machine direction and the cross-machine direction, said transfer fabric having a velocity of from about fifteen (15) to about thirty (30) percent slower than said carrier fabric, said gaseous pressure being precipitated by a vacuum source, and wherein sufficient wet strength material is incorporated in said web that said web is a durable and effective spill wipe-up article.

18. The process of claim 17 further comprising the steps of:

adhesively securing said web to a creping cylinder having a surface velocity substantially equal to the velocity of said transfer fabric; and dry-creping said web from said creping cylinder with a doctor blade.

19. The process of claim 18 further comprising the step of reeling said web at a velocity at least about equal to the surface velocity of said creping cylinder to substantially remove dry-creping induced extensibility therefrom.

20. The process of claim 18 further comprising the step of reeling said web at a sufficiently slower velocity than the surface velocity of said creping cylinder that said web has a predetermined degree of residual dry-crepe whereby a hybrid stress-strain modulus is imparted to said web which is manifested by the web acting somewhat like a dry-creped web at low stress levels when wet, and the web having a substantially higher stress/strain modulus through its middle one-third range of MD extensibility than a purely dry-creped web which is otherwise substantially identical and has substantially equal ultimate MD extensibility.

21. The process of claim 1, 17, or 18 wherein said forming of said embryonic web comprises forming a multi-layer embryonic web from a plurality of papermaking furnishes.

22. Wet-microcontracted tissue paper having high bulk, substantial machine-direction extensibility, and being characterized by a substantially greater stress/strain modulus through its lowest one-third range of MD extensibility than comparably extensible dry-creped paper which is otherwise substantially identical tissue paper, said wet-microcontracted tissue paper being made by the process comprising the steps of:

forming an embryonic paper web from an aqueous fibrous papermaking furnish;

forwarding said embryonic web at a first velocity on an endless carrier fabric to a transfer zone;

non-compressively removing sufficient water from said embryonic web that it has a fiber consistency of from about ten (10) to about thirty (30) percent immediately prior to its reaching said transfer zone to enable said embryonic web to be transferred to an endless foraminous transfer fabric at said transfer zone, said transfer fabric having a sufficiently greater void volume than said carrier fabric to obviate macrofolding of said web;

forwarding at a second velocity said endless foraminous transfer fabric along a looped path in contacting relation with a transfer head disposed at said transfer zone, said transfer head having a convex fabric-contacting surface, said second velocity being substantially less than said first velocity;

guiding said carrier fabric and said transfer fabric to cause them to converge and then diverge at acute angles while transversing said convex surface, said acute angles being sufficiently small and the curvature of said convex surface being sufficiently large to substantially obviate fabric-tension-induced compaction of said embryonic web as it passes through said transfer zone;

applying only a sufficient level of differential gaseous pressure across said embryonic web at said transfer zone to cause said embryonic web to transfer to said transfer fabric in said transfer zone without precipitating substantial compaction of said embryonic web; and completing the papermaking-machine drying of said embryonic web while maintaining the macroscopic interfiber relationships therein in the plane of the web and without overall mechanical compaction of the web.

23. The wet-microcontracted tissue paper of claim 22 wherein said process comprises dewatering said embryonic web to a fiber consistency of from about ten (10) to about twenty (20) percent immediately prior to transferring it to said transfer fabric, said transfer fabric having a mesh count of from about six (6) to about fifteen (15) filaments per centimeter in both the machine direction and the cross-machine direction, said transfer fabric having a velocity of from about fifteen (15) to about thirty (30) percent slower than said carrier fabric, said gaseous pressure being precipitated by a vacuum source, and wherein sufficient wet strength material is incorporated in said web that said web is a durable and effective spill wipe-up article.

24. The wet-microcontracted tissue paper of claim 23 wherein said process further comprises the steps of:

adhesively securing said web to a creping cylinder having a surface velocity substantially equal to the velocity of said transfer fabric; and dry-creping said web from said creping cylinder with a doctor blade.

25. The wet-microcontracted tissue paper of claim 24 wherein said process further comprises the step of reeling said web at a velocity at least about equal to the surface velocity of said creping cylinder to substantially remove dry-creping induced extensibility therefrom.

26. The wet-microcontracted tissue paper of claim 24 wherein said process further comprises the step of reeling said web at a sufficiently slower velocity than the surface velocity of said creping cylinder that said web has a predetermined degree of residual dry-crepe whereby a hybrid stress/strain modulus is imparted to said web which is manifested by the web acting somewhat like a dry-creped web at low stress levels when wet, and the web having a substantially higher stress-strain modulus through its middle one-third range of MD extensibility than a purely dry-creped web which is otherwise substantially identical and has substantially equal ultimate MD extensibility.

27. The wet-microcontracted tissue paper of claim 23, 24, or 25 wherein said web comprises at least two layers, and said forming step comprises forming said web as a multi-layer composite from at least two discrete aqueous fibrous papermaking furnishes.

* * * * *

UNITED STATES PATENT AND TRADEMARK OFFICE

CERTIFICATE OF CORRECTION

PATENT NO. : 4,440,597

DATED : April 3, 1984

INVENTOR(S) : Edward R. Wells and Thomas A. Hensler

It is certified that error appears in the above-identified patent and that said Letters Patent are hereby corrected as shown below:

Column 14, line 26, "of" should read --at--.

Column 20, line 35, "23, 24 or 25" should read --22, 23, or 24--.

Signed and Sealed this

*Second* Day of *April 1985*

[SEAL]

*Attest:*

DONALD J. QUIGG

*Attesting Officer*

*Acting Commissioner of Patents and Trademarks*